US005268725A

United States Patent [19]

Koga et al.

[11] Patent Number: 5,268,725

[45] Date of Patent: Dec. 7, 1993

[54] SHEET MEMBER CARRIER DEVICE WITH GROUNDING MEANS

[75] Inventors: Shinji Koga, Hirakata; Ryuji Wataki, Nara; Hiroyuki Nonaka, Osaka, all of Japan

[73] Assignee: Mita Industrial Co., Ltd., Japan

[21] Appl. No.: 790,443

[22] Filed: Nov. 12, 1991

[30] Foreign Application Priority Data

Nov. 19, 1990 [JP] Japan ..... 2-313136

[51] Int. Cl.[5] ..... G03G 15/16

[52] U.S. Cl. ..... 355/275; 355/274

[58] Field of Search ..... 355/274, 271, 277, 273, 355/275, 272; 271/273

[56] References Cited

U.S. PATENT DOCUMENTS

| | | | |
|---|---|---|---|
| 3,697,170 | 10/1972 | Bhagat et al. | 355/274 X |
| 4,110,027 | 8/1978 | Sato et al. | 355/274 |
| 4,984,024 | 1/1991 | Ohkaji et al. | 355/273 |
| 5,012,290 | 4/1991 | Berkes et al. | 355/275 X |

FOREIGN PATENT DOCUMENTS

| | | | |
|---|---|---|---|
| 0219976 | 9/1986 | Japan | 355/274 |
| 0136068 | 6/1988 | Japan | 355/274 |
| 0010389 | 1/1990 | Japan | 355/275 |
| 0110586 | 4/1990 | Japan | 355/275 |
| 0069976 | 3/1991 | Japan | 355/275 |

*Primary Examiner*—A. T. Grimley
*Assistant Examiner*—T. A. Dang
*Attorney, Agent, or Firm*—Beveridge, DeGrandi, Weilacher & Young

[57] ABSTRACT

A sheet member conveying device is equipped with an endless sheet member conveyor belt composed of a semiconductor material and an electrical charging device which electrically charges the sheet member conveyor belt in order to transfer a toner image formed on the surface of a rotary drum onto a sheet member at a toner image transfer position. The sheet member conveyor belt is put around a plurality of rollers and moves from the toner image transfer position toward a sheet member peeling position. A grounding device is provided between the toner image transfer position and the sheet member peeling position along the sheet member conveyor belt in order to decrease the surface potential which is due to the charge of the sheet member conveyor belt.

9 Claims, 4 Drawing Sheets

SHEET MEMBER CARRIER DEVICE WITH GROUNDING MEANS

FIELD OF THE INVENTION

The present invention relates to a sheet member conveying device adapted to image forming apparatuses such as electrophotographic copying machines, electrophotographic printers, or the like.

DESCRIPTION OF THE PRIOR ART

A sheet member conveying device that includes an endless sheet member conveyor belt has been put into practical use in, for example, electrophotographic copying machines in order to convey a sheet member such as a plain paper onto which is transferred a toner image formed on the surface of a rotary drum. One example of the conventional sheet member conveying device is the one disclosed in, for example Japanese Laid-Open Patent Publication No. 83766/1988.

The sheet member conveying device disclosed in the above publication includes an endless sheet member conveyor belt composed of a semiconductor material having a resistivity of from $10^{10}$ to $10^{13}$ ohms-cm and an electrically charging means (hereinafter simply referred to as a charging mean). The sheet member conveyor belt is put around a plurality of rollers inclusive of a driving roller and driven rollers, and is driven by the driving roller. The sheet member conveyor belt is further so provided as to move toward a sheet member peeling position from a toner image transfer position which is close to the rotary drum that has a photosensitive material arranged on the surface thereof. One of the plurality of rollers consists of a grounding roller disposed at the sheet member peeling position. The sheet member conveyor belt at the toner image transfer position to charge the sheet member conveyor belt, so that the toner image (visible image) formed on the surface of the rotary drum can be transferred onto the sheet member on the sheet member conveyor belt.

With rotation of the rotary drum, the toner image corresponding to the document is formed on the photosensitive material on the surface of the rotary drum by a means well known to those skilled in the art. A sheet member is fed to the toner image transfer position on the sheet member conveyor belt by a paper feeder that operates in synchronism with the rotary drum. The sheet member conveyor belt is driven in synchronism with the paper feeder and is charged by the charging means at the toner image transfer position. At this time, the sheet member has a polarity opposite to the polarity of toner particles that fo n a toner image on the photosensitive material. The toner image formed on the surface of the rotary drum is transferred onto the surface of the sheet member fed to the toner image transfer position. The sheet member onto which the toner image has been transferred is conveyed by being attracted to, the sheet member conveyor belt, and peeled off at the sheet member peeling position to be fed to a fixing device.

In the conventional sheet member conveying device constituted as described above roughly, the sheet member conveyor belt is charged by the charging means at the toner image transfer position. It is desired that the surface potential of the sheet member conveyor belt owing to the electric charge is gradually lowered after the sheet member conveyor belt has passed the toner image transfer position. and is lowered to a considerably low level at the time when the sheet member conveyor belt has reached the sheet member peeling position. If the surface potential is maintained at a relatively higher level at the sheet member peeling position, the adhesion of toner image transferred onto the sheet member becomes instable after the sheet member has been peeled off from the sheet member conveyor belt at the sheet member peeling position, i.e., the toner image is disturbed and clear image can not obtained. The reasons will now be described with reference to FIG. 5.

Reference numeral 100 indicates part of the endless sheet member conveyor belt composed of a semiconductor material, and 102 indicates part of the sheet member positioned on the surface of the sheet member conveyor belt 100. The sheet member 102, in this case, consists of a synthetic resin sheet such as a PET (polyethylene terephthalate) film used for the OHP (overhead projector). A rotary drum 104 is disposed close to the front surface of the sheet member conveyor belt 100 at the toner image transfer position X, and a positive corona charger 106 which is a charging means is disposed on the side of the back surface of the sheet member conveyor belt. The sheet member conveyor belt 100 is put around a roller 108 at the sheet member peeling position Y, and the roller 108 is rotated in the counterclockwise direction. The sheet member conveyor belt 100 moves from the toner image transfer position X toward the sheet member peeling position Y.

The sheet member conveyor belt 100 is charged to positive polarity by the positive corona charger 106 at the toner image transfer position X. The sheet member 102 fed onto the surface of the sheet member conveyor belt 100 is so polarized by the electrostatic induction that the back surface thereof has the negative polarity and the front surface thereof has the positive polarity. Consequently, the sheet member 102 is attracted onto the surface of the sheet member conveyor belt 100, and is reliably carried. The toner particles that constitute toner image formed on the surface of the rotary drum are charged to negative polarity. At the toner image transfer position X, the toner particles are attracted by the sheet member conveyor belt 100 that has the opposite polarity due to its electrostatic force, and are transferred onto the sheet member 102 on the surface of the belt 100. Since the front surface of the sheet member 102 has been positively charged the negatively charged toner particles are held on the surface of the sheet member 102. The polarities which are diagramed are maintained until the sheet member 102 arrives at the sheet member peeling position Y.

At the sheet member peeling position Y, the sheet member 102 is peeled off from the sheet member conveyor belt 100 and is conveyed toward the fixing device that is not shown. If the surface potential of the sheet member conveyor belt 100 is maintained at a relatively higher value at the sheet member peeling position Y, there takes place ionization when the sheet member 102 peels off from the surface of the sheet member conveyor belt 100 and the negative charge migrates to the sheet member 102. At a result, polarities of charges polarized in the sheet member 102 are inverted. That is, the positive polarity on the front surface of the sheet member 102 is inverted to the negative polarity, and the negative polarity on the back surface is inverted to the positive polarity. Due to the inversion phenomenon of polarities of the charges, the front surface of the sheet member 102 has the negative polarity which is the same as the polarity of the toner particles. Therefore, the toner particles tend to be repelled by the surface of the sheet member 102, so that the adhesion becomes instable. Accordingly, the toner image transferred to and formed on the surface of the sheet member 102 is easily disturbed and clear image is not guaranteed anymore.

In the aforementioned conventional sheet member conveyor device, the roller disposed at the sheet member peeling position Y is comprised of a grounding roller 108 in order to lower the high surface potential of the sheet member conveyor belt 100 at the sheet member peeling position Y. With the above constitution, however, it is virtually impossible, viewed from the practical use, to lower the high surface potential of the sheet member conveyor belt 100 down to a sufficient degree at the sheet member peeling position Y. That is, the high surface potential of the sheet member conveyor belt 100 due to the charge effected at the toner image transfer position X drops spontaneously to some extent as the sheet member conveyor belt 100 moves from the toner image transfer position X toward the sheet member peeling position Y since the sheet member conveyor belt 100 is composed of a semiconductor material. However, the degree of drop is very small and the potential remains at a considerably high level at the sheet member peeling position Y. Moreover, grounding by the grounding roller 108 is effected at a portion where the sheet member conveyor belt 100 comes in contact with the grounding roller 108, the grounding becoming more efficient with an increase in the contact area. That is, grounding is effected more efficiently at the contact completion point at which contacting of the sheet member conveyor belt 100 and the grounding roller 108 is fully effected than at the contact start point at which the contacting is made for the first time. Therefore, it is not possible to fully lower the surface potential at the sheet member peeling position Y at which the sheet member conveyor belt starts coming in contact with the grounding roller 108. The surface potential can be fully lowered only at a position Z which is on the downstream side of the sheet member peeling position Y by about 180 degrees.

In order to solve the above-mentioned problem inherent in the conventional sheet member conveying device it may be contrived to provide a positive corona charger which is a charging means at a position above the sheet member peeling position Y shown in FIG. 5. The surface of the sheet member 102 is charged again to the positive polarity opposite to that of the toner particles by the positive corona charger, in order to prevent the inversion phenomenon of polarities of the charges to stabilize the polarities of the charges of the sheet member 102 and prevent the toner particles on the surface of the sheet member 102 from being disturbed.

According to this method, however, the positive corona charger which is the charging means must be disposed at a position above the sheet member peeling position Y, and it further becomes necessary to provide a high-voltage power source device to energize the positive corona charger. Therefore, the device becomes of increased size and expensive.

SUMMARY OF THE INVENTION

The principal object of the present invention is to provide an improved sheet member conveying device which stabilizes the toner image transferred onto the sheet member and guarantees clear image while decreasing the size of the device and reducing the manufacturing cost.

In order to achieve the above-mentioned object according to the present invention, there is provided a sheet member conveying device comprising an endless sheet member conveyor belt which is composed of a semiconductor material, which is put around a plurality of rollers and is driven by the rollers, and which moves toward a sheet member peeling position from a toner image transfer position located close to a rotary drum that has a photosensitive material arranged on the surface thereof, and a charging means which charges said sheet member conveyor belt in order to transfer a toner image formed on the surface of said rotary drum onto the sheet member at said toner image transfer position, wherein a grounding means is provided between said toner image transfer position and said sheet member peeling position along said sheet member conveyor belt in order to lower the surface potential that is due to the charge of said sheet member conveyor belt.

Other objects and features of the present invention will become apparent from the detailed description of the embodiments of the sheet member conveying device constituted according to the present invention in conjunction with the accompanying drawings.

DETAILED DESCRIPTION OF THE PREFERRED EMBODIMENTS

Figure 1:
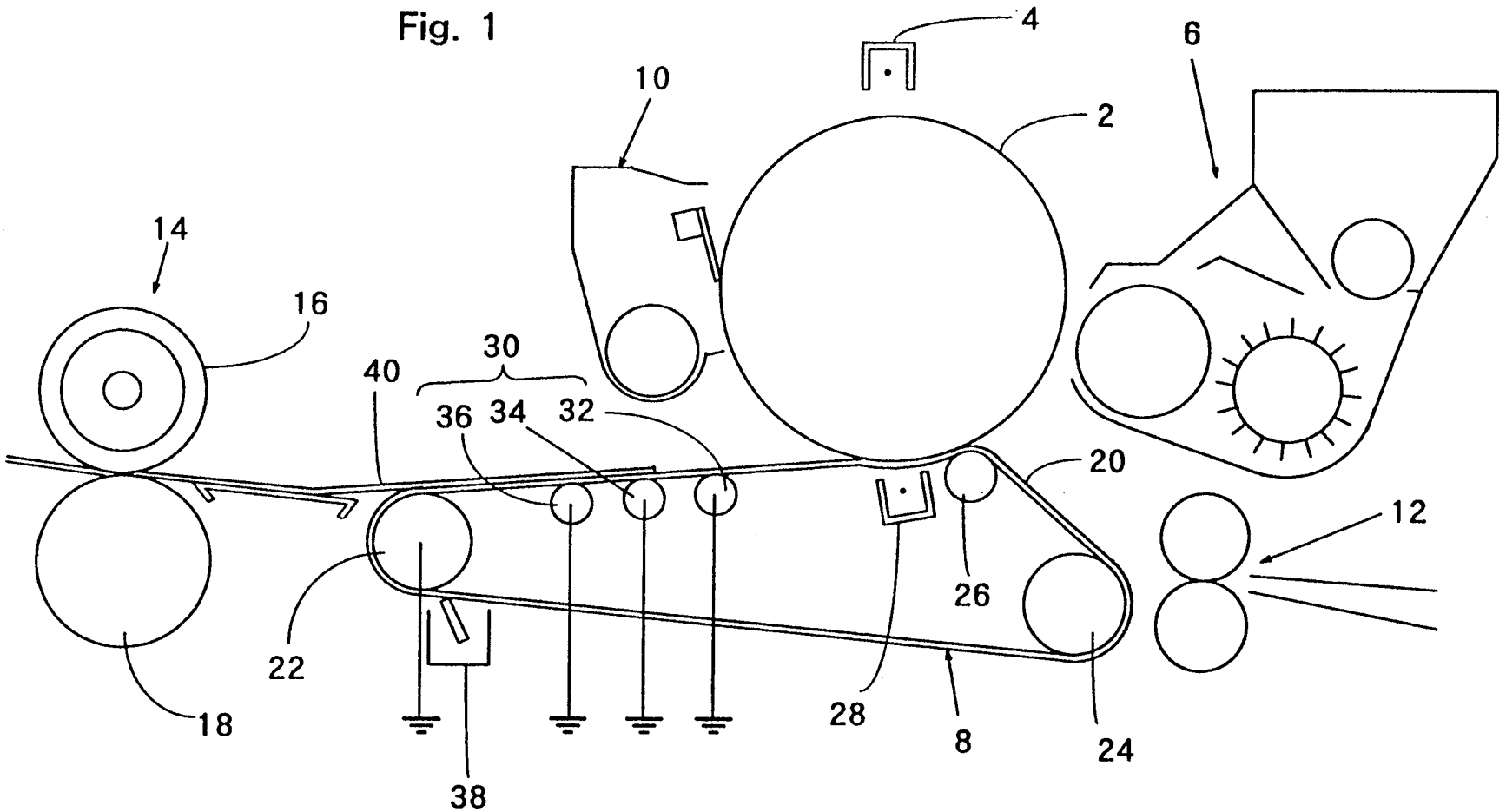
FIG. 1 is a side view which schematically illustrates major portions of an electrophotographic copying machine equipped with a sheet member conveying device constituted according to an embodiment of the present invention.

An embodiment of the sheet member conveying device constituted according to the present invention will now be described in detail in conjunction with the accompanying drawings. In FIG. 1, reference numeral 2 indicates a rotary drum having a photosensitive material disposed on the surface thereof. The rotary drum 2 is rotatably supported in an electrophotographic copying machine that is not clearly shown in the drawing. Around the rotary drum 2 are disposed a positive corona charger 4 which is a charging device, a developing device 6, a sheet member conveying device 8 constituted according to the present invention, and a cleaning device 10. On the upstream side of the sheet member conveying device 8 (right side in FIG. 1) are provided a pair of paper-feed rollers 12 that feed sheet members held in a paper-feed cassette (not shown) to the sheet member conveying device 8. The sheet members consist of common papers or sheets for the above-mentioned OHP use. On the downstream side of the sheet member conveying device 8 (left side in FIG. 1) is provided a fixing device 14 which in this embodiment, is constituted by a heat roller 16 that contains the source of heat and a pressing roller 18 which is arranged in intimate contact with the heat roller 16. The above constitution has been well known to the people skilled in the art except the sheet member conveying device 8.

The sheet member conveying device 8 is equipped with an endless sheet member conveyor belt 20 which is composed of a semiconductor material. The sheet member carrier belt 20 is put around a driving roller 22, a driven roller 24 and an intermediate roller 26, and is driven by the driving roller 22. The sheet member conveyor belt 20 is so provided as to move from the toner image transfer position which is close to the rotary drum 2 toward the sheet member peeling position at which the driving roller 22 is disposed. At the toner image transfer position, a positive corona charger 28 which is a charging means is provided on one side of the sheet member conveyor belt 20, which side is opposite to the rotary drum 2, (i.e. on the side of back surface of the sheet member conveyor belt 20). The positive corona charger 28 charges the sheet member conveyor belt 20 to the polarity opposite to the polarity of toner particles that are adhered as toner image on the surface of the rotary drum 2.

A grounding means 30 is provided between the toner image transfer position and the sheet member peeling position along the sheet member conveyor belt 20 in order to lower the surface potential that is due to the charge of the sheet member conveyor belt 20. In the embodiment of FIG. 1, the grounding means 30 is constituted by three grounding members or grounding rollers 32. 34 and 36 which are disposed at predetermined intervals in the direction in which the sheet member conveyor belt 20 moves in a manner to come in contact with the back surface of the sheet member conveyor belt 20. The grounding rollers 32, 34 and 36 are made of a conductor such as iron, aluminum, or the like, and are grounded by being connected via conductors to supporting frames (not shown) of the electrostatic photocopying machine. In this embodiment, the grounding rollers 32, 34 and 36 have substantially the same diameter. Accordingly, the grounding rollers 32, 34 and 36 have nearly the same contact areas relative to the sheet member conveyor belt 20.

Here, the driving roller 22 is grounded as diagramed, and other driven roller 24 and intermediate roller 26, too, are grounded, though not shown. In FIG. 1, reference numeral 38 indicates a cleaning means which cleans the surface of the sheet member conveyor belt 20. The cleaning means 38 is disposed on the downstream side of the driving roller 22 along the sheet member conveyor belt 20.

Described below is the operation of the thus constituted sheet member conveying device 8 together with the copying process. The positive corona charger 4 uniformly charges the surface of the rotating rotary drum 2 to the positive polarity. As a document image is exposed to light by an optical system (not shown), an electrostatic latent image that corresponds to the document image is formed on the surface of the rotary drum 2. In the developing device 6, the negatively charged toner particles having polarity opposite to that of the electrostatic latent image adhere to the electrostatic image, and are visualized. The sheet member conveyor belt 20 and the pair of paper-feed rollers 12 are driven in synchronism with the rotary drum 2. A voltage is applied to the positive corona charger 28, and the sheet member conveyor belt 20 is positively charged at the toner image transfer position. The sheet member is fed onto the surface of the sheet member conveyor belt 20 from the pair of paper-feed rollers 12 that are rotating.

Figure 5:
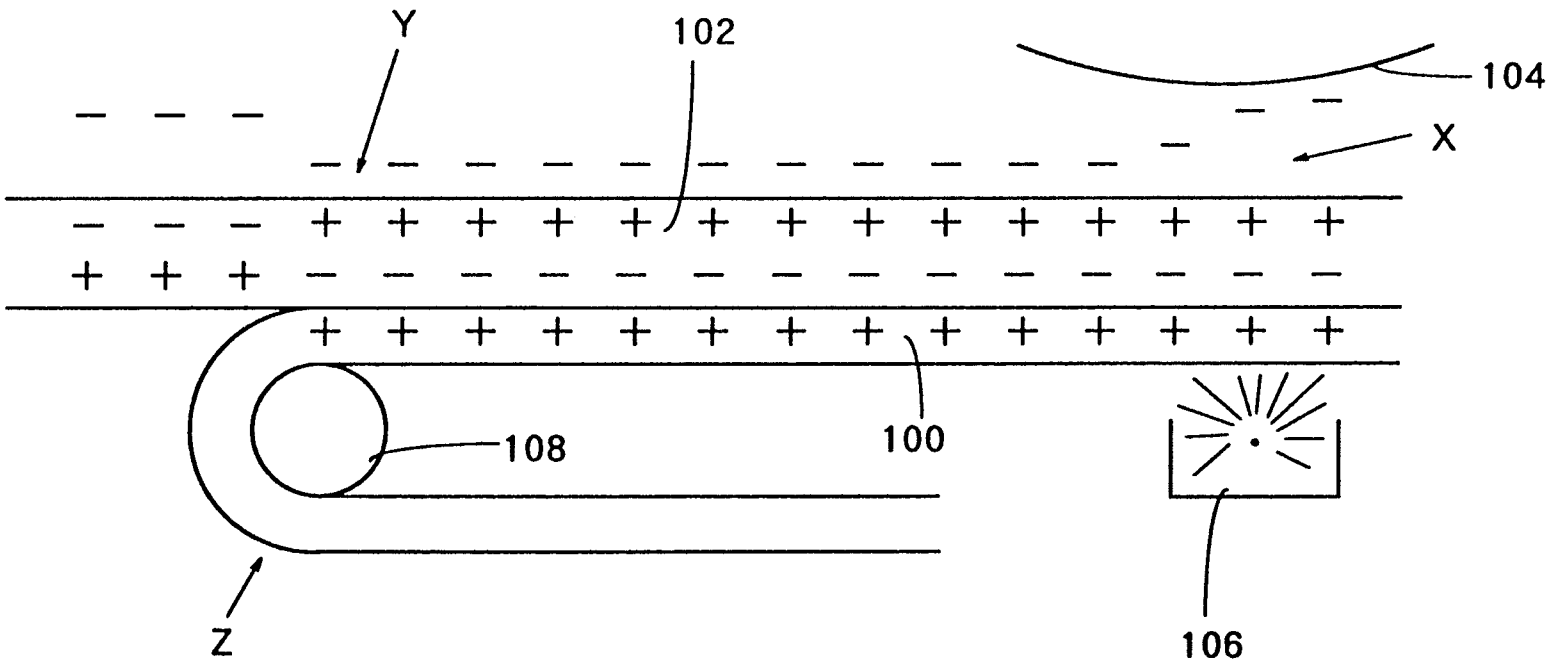
FIG. 5 is a model diagram explaining the phenomenon of disturbance in the toner image transferred onto the surface of the sheet member using the conventional sheet member conveying device.

In a step in which the sheet member passes through the toner image transfer position between the sheet member conveyor belt 20 and the rotary drum 2, the interior of the sheet member is so polarized that the surface on the side of the rotary drum 2 has the positive polarity and the back surface of the sheet side of the sheet member conveyor belt 20 has the negative polarity. The toner image formed on the surface of the rotary drum 2 is transferred to the surface of the sheet member. That is, the toner particles forming the toner image are negatively charged. At the toner image transfer position, the toner particles are attracted by the electrostatic force of the sheet member conveyor belt 20 that has the positive polarity and are transferred onto the sheet member that is attracted to the surface of the belt 20. Since the front surface of the sheet member has been positively charged, the negatively charged toner particles are held on the surface of the sheet member. The sheet member to which the toner image is transferred is conveyed, being attracted, by the sheet member carrier belt 20, peeled at the sheet member peeling position, and is sent to the fixing device 14. In FIG. 1, reference numeral 40 indicates the sheet member. The polarities of the sheet members in the course of from the toner image transfer position up to the sheet member peeling position are same as shown in FIG. 5.

The sheet member conveyor belt 20 having a relatively high surface potential due to the charging at the toner image transfer position, comes into contact with the grounding rollers 32 34 and 36 in this order as it moves from the toner image transfer position to the sheet member peeling position, so that the surface potential decreases stepwisely. The surface potential is lowered to a desired low level at a moment when the belt has reached the sheet member peeling position. Therefore, the inversion phenomenon of polarities of charges described with reference to FIG. 5 is prevented from taking place, and the polarities of charges of the sheet member and of the toner image transferred to the surface of the sheet member are maintained unchanged even after the sheet member is peeled off from the sheet member conveyor belt 20.

Figure 3:
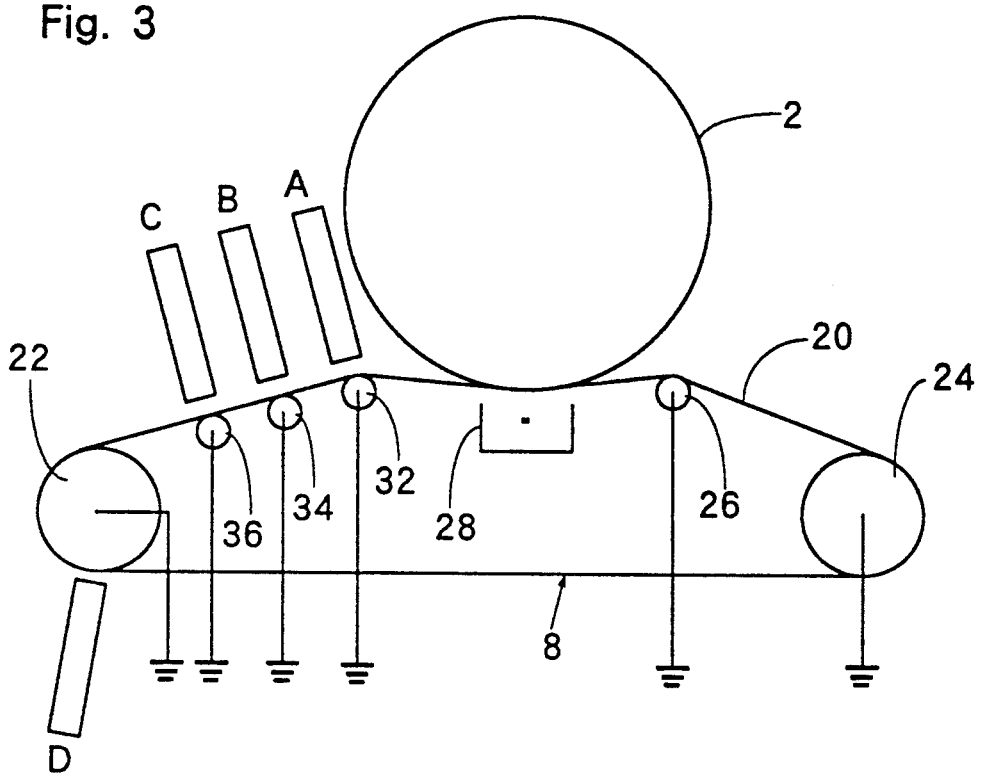
FIG. 3 is a side view which schematically shows how the experiments are carried out by using the sheet member conveying device shown in FIG. 1 in order to confirm the effects of the present invention.

The inventors have conducted experiment using the sheet member conveying device 8 constituted substantially in the same manner as the one described with reference to FIG. 1 in order to confirm the effects of the present invention. FIG. 3 roughly illustrates the experimental method in which the same portions as those of FIG. 1 are indicated by the same reference numerals. The driving roller 22, driven roller 24 and intermediate roller 26 are made of an electric conductor and are grounded. Materials of the constituent members and the experimental conditions are as described below.

| | |
|---|---|
| Sheet member conveyor belt 20: | |
| material | polyurethane rubber |
| thickness | 0.6 mm |
| resistivity | $10^{11}$ to $10^{13}$ ohms-cm |
| surface fluorine-coated layer | 20 μm |
| Grounding rollers: | |
| material | iron |
| diameter | 8 mm |

-continued

| | |
|---|---|
| Driving roller 22: | |
| material | aluminum |
| diameter | 20 mm |
| Driven roller 24: | |
| material | iron (polyacetal is adhered to the surface to prevent slipping) |
| diameter | 20 mm |
| Peripheral speed of the rotary drum 2 and the sheet member conveyor belt 20: | 400 mm/sec. |
| Positive corona charger 28: | corona voltage of 5.5 kV is applied |
| Positions at which the surface potential of the sheet member conveyor belt 20 is measured: | four places A, B, C and D (where probes of surface potentiometers are located) |

Under the above-mentioned conditions, probes of the surface potentiometers were installed at four places A, B, C and D along the sheet member conveyor belt 20 in order to measure the surface potentials at each of the positions. In order to measure the effects of the conventional device, furthermore, the surface potentials were measured at four places A, B, C and D along the sheet member conveyor belt 20 under the same conditions as those mentioned above excepting removing the grounding rollers 32, 34 and 36. The experiment results are shown in the following table and in the diagram of FIG. 4, in which symbols A, B, C and D represent positions where the surface potentials are measured along the sheet member conveyor belt 20, and numerals show surface potentials (unit in volts) at each of the positions. Though not measurable, it is estimated that the surface potential of the sheet member conveyor belt 20 is 600 to 800 V just on the downstream side of the toner image transfer position.

| Grounding rollers | A | B | C | D |
|---|---|---|---|---|
| Three rollers | 400 | 250 | 100 | 0 |
| No roller | 500 | 450 | 400 | 20 |

In order to prevent the aforementioned inversion phenomenon of the polarities of charges that takes place as the sheet member is peeled off, it is important to fully lower the surface potential of the sheet member conveyor belt 20 just before the sheet member peeling position. The above experimental results will now be compared from this point of view.

Figure 4:
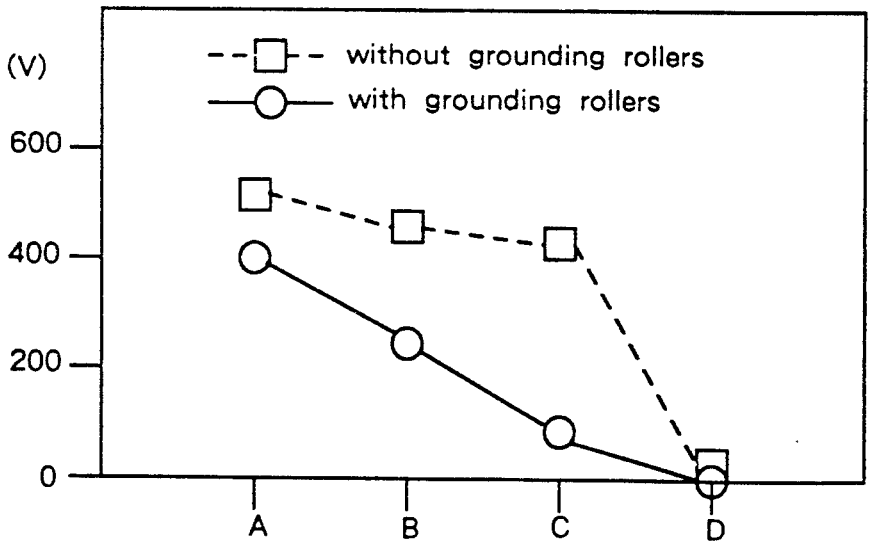
FIG. 4 is a diagram which shows the effects of the present invention confirmed by the experiments shown in FIG. 3 in comparison with the effects of a conventional device.

Referring to the above table and FIG. 4, when there is no grounding roller between the toner image transfer position and the sheet member peeling position, the surface potential gradually decreases since the sheet member carrier belt 20 is composed of the semiconductor material. However, the degree of decrease is very small and the surface potential at the position C is as high as 400 V. The above-mentioned inversion phenomenon of the polarities of charges takes place in the sheet member at the sheet member peeling position.

On the other hand in the case of the above-mentioned embodiment of the present invention provided with three grounding rollers, the surface potential gradually decreases and the degree of decrease is considerably great. That is, the surface potential decreases to 100 V at the position C, which is a great reduction. Accordingly, there does not take place the inversion phenomenon of the polarities of charges in the sheet member.

Figure 2:
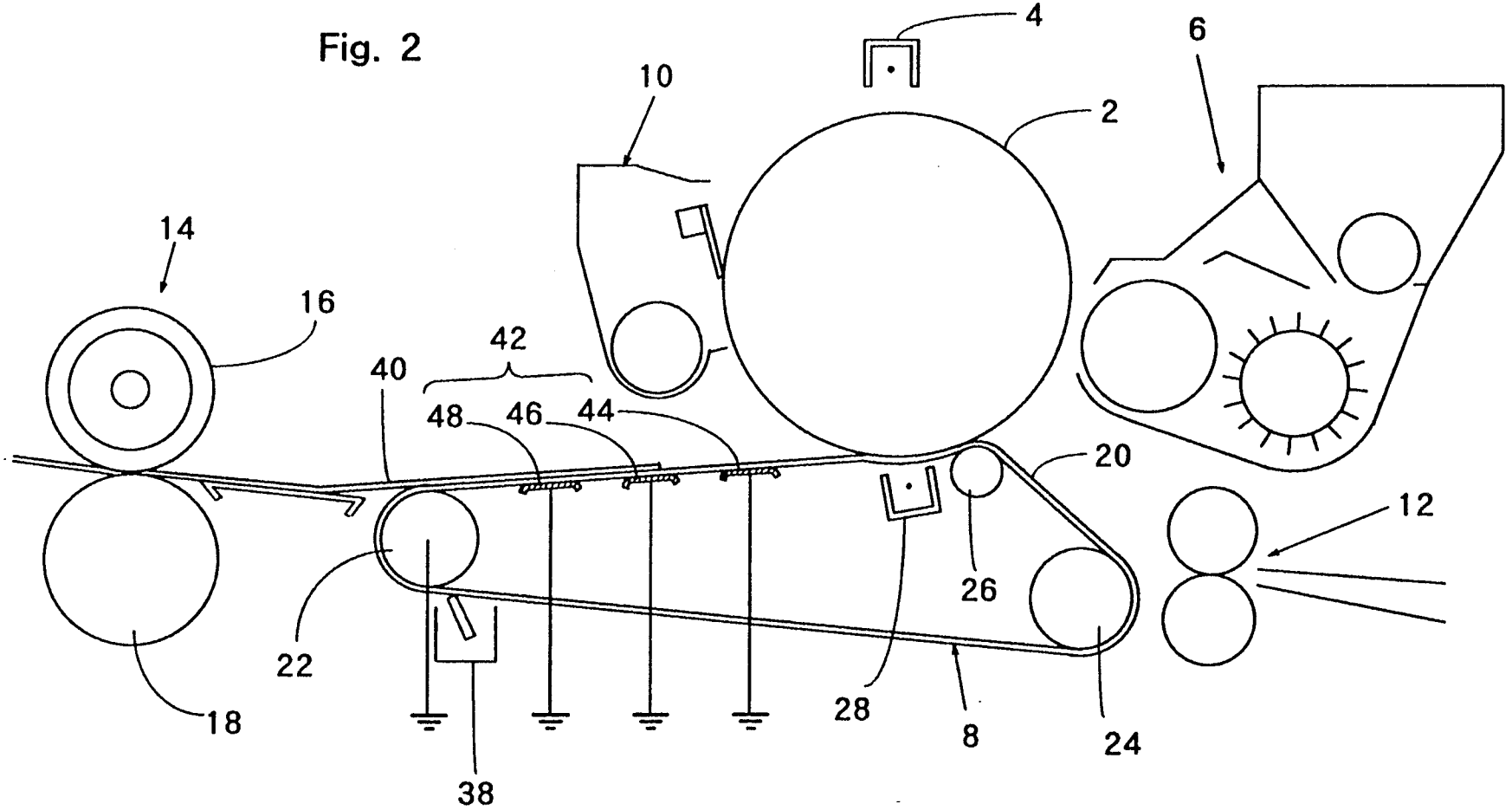
FIG. 2 is a side view which schematically illustrates major portions of an electrophotographic copying machine equipped with a sheet member conveying device constituted according to another embodiment of the present invention.

FIG. 2 illustrates another embodiment of the present invention in which a grounding means 42 is constituted by grounding plates 44, 46 and 48 which are grounding members instead of the grounding rollers 32, 34 and 36 of FIG. 1. The constitution in other respects is substantially the same as that of the embodiment of FIG. 1 and the same portions are indicated by the same reference numerals but are not described here again. The grounding plates 44, 46 and 48 are made of an electric conductor such as steel plates, or the like, and are grounded by being connected via conductors to a frame (not shown) of the electrostatic photocopying machine. In the diagramed embodiment the grounding plates 44, 46 and 48 are constituted by steel plates having substantially the same shape, and are brought into contact with the back surface of the sheet member carrier belt 20 with substantially the same contact area. It is desired that the surfaces of the grounding plates 44, 46 and 48 that come in contact with the back surface of the sheet member conveyor belt 20 have a relatively small coefficient of friction. It can be contrived to constitute the grounding plates 44, 46 and 48 by using a stainless steel or to effect the electroplating onto the surfaces of the steel plates. The grounding function of the grounding plates 44, 46 and 48 is the same as the one explained with reference to the embodiment of FIG. 1, and is not described here again.

In the sheet member conveying device 8 of the present invention explained with reference to FIGS. 1 and 2, it can be contrived to stepwisely increase the contact area of the grounding rollers 32, 34 and 36 or grounding plates 44, 46 and 48 which are grounding members relative to the back surface of the sheet member conveyor belt 20 from the upstream side toward the downstream side in the direction which the sheet member conveyor belt 20 moves. Specifically speaking, in the case of the grounding rollers 32, 34 and 36 the diameter may be stepwisely increased from the upstream side toward the downstream side in the direction which the sheet member conveyor belt 20 moves. In the case of the grounding plates 44, 46 and 48, the size of the plain shape may be stepwisely increased from the upstream side toward the downstream side in the direction which the sheet member conveyor belt 20 moves.

It can further be contrived to stepwisely decrease the electric resistance of the grounding rollers 32, 34 and 36 or the grounding plates 44, 46 and 48 which are grounding members relative to the grounding from the upstream side toward the downstream side in the direction which the sheet member conveyor belt 20 moves. Specifically speaking, resistances of different values may be interposed in the conductors that couple the grounding rollers 32, 34, and 36 or the grounding plates 44, 46 and 48 to the grounding.

In the aforementioned embodiments, grounding members such as grounding rollers or grounding plates are provided in plural numbers between the toner image transfer position and the sheet member peeling position. However, the desired effect can be accomplished by the provision of at least one grounding member.

The following effects are obtained by the sheet member conveying device of the present invention that was described above by way of an embodiment.

(1) Owing to the provision of the grounding means between the toner image transfer position and the sheet member peeling position along the sheet member conveyor belt, it is possible at the sheet member peeling position to greatly decrease the high surface potential that is due to the charge of the sheet member conveyor belt at the toner image transfer position. Therefore, there does not take place the inversion phenomenon of the polarities of charges in the sheet member at the time when the sheet member is peeled off from the sheet member conveyor belt at the sheet member peeling position. Therefore, there is no need of providing any particular charging means near the sheet member peeling position or any high-tension power source device for the charging means. The toner image transferred onto the surface of the sheet member remains stable after it is peeled off from the sheet member conveyor belt, and is reliably prevented from being disturbed thus guaranteeing clear image.

Moreover, since there is no need of providing any charging means or any high-tension power source device therefor to prevent the disturbance of the toner image, the size of the device can be decreased and its cost can be decreased as well.

Furthermore, since the sheet member conveyor belt retains a potential which is large enough to attract the sheet members on the upstream side of the sheet member peeling position, the sheet members are reliably carried by the sheet member conveyor belt.

(2) When the grounding means includes at least one grounding member which consists of a grounding roller that is so disposed as to come in contact with the back surface of the sheet member conveyor belt, the sheet member conveyor belt is prevented from flapping and meandering. Accordingly the toner image of the sheet member is prevented from being disturbed by the flapping and meandering of the sheet member conveyor belt, and clear image is guaranteed. The sheet member conveyor belt is prevented from flapping and meandering too, even when the grounding members are constituted by the grounding plates.

(3) When the grounding means described in (2) above includes a plurality of grounding members that are arranged at predetermined intervals in a direction in which the sheet member conveyor belt moves and the grounding members have substantially an equal contact area relative to the back surface of the sheet member conveyor belt, the surface potential of the sheet member conveyor belt can be stepwisely decreased relatively easily.

(4) When the grounding members described in (3) above have contact areas that stepwisely increase relative to the back surface of the sheet member conveyor belt from the upstream side toward the downstream side in the direction which the sheet member conveyor belt moves, the surface potential can be decreased more smoothly. The same effects can be obtained even when the electric resistance of the grounding members relative to the grounding is set to decrease stepwisely from the upstream side toward the downstream side in the direction which the sheet member conveyor belt moves.

(5) When a plurality of grounding members are provided between the toner image transfer position and the sheet member peeling position as is apparent from the experiment shown in FIG. 3, the surface potential of the sheet member conveyor belt at the sheet member peeling position can be brought to zero at a position where it starts separating away from the roller. When a cleaning means is provided on the downstream side therefore, the cleaning effect can be further increased.

We claim:

1. A sheet member conveying device comprising:

an endless sheet member conveyor belt which is composed of a semiconductor material, which is put around a plurality of rollers and driven by the rollers, and which moves toward a sheet member peeling position which is downstream from a toner image transfer position close to a rotary drum that has a photosensitive material arranged on a surface thereof;

a transfer charging means which electrically charges said sheet member conveyor belt in order to transfer a toner image formed on the surface of said rotary drum onto the sheet member at said toner image transfer position, said sheet member peeling position and said transfer charging means defining a sheet member conveyance path portion which has no further transfer charging means between said sheet member peeling position and said transfer charging means; and a grounding means provided between said toner image transfer position and said sheet member peeling position along said sheet member conveyor belt in order to lower a surface potential that is due to a charge on said sheet member conveyor belt before said sheet member is peeled off from said sheet member conveyor belt at said sheet peeling position, said grounding means including at least one grounding member that is disposed so as to come into contact with a back surface of said sheet member conveyor belt downstream with respect to said transfer charging means at said toner image transfer position and upstream with respect to said sheet member peeling position, at said portion of said sheet member conveyance path.

2. A sheet member conveying device according to claim 1, wherein said grounding member is constituted by a grounding roller.

3. A sheet member conveying device according to claim 1, wherein said grounding member is constituted by a grounding plate.

4. A sheet member conveying device according to claim 1, wherein said grounding means includes a plurality of grounding members that are disposed at predetermined intervals in a direction in which said sheet member conveyor belt moves, said grounding members are disposed so as to come into contact with said back surface of said sheet member conveyor belt, and said grounding members have a substantially equal contact area relative to said back surface of said sheet member conveyor belt.

5. A sheet member conveying device according to claim 4, wherein said grounding members are constituted by grounding rollers that have a substantially equal diameter.

6. A sheet member carrier device according to claim 1, wherein said grounding means includes a plurality of grounding members that are disposed at predetermined intervals in a direction in which said sheet member conveyor belt moves, said grounding members are disposed so as to come into contact with said back surface of said sheet member conveyor belt, and contact areas between said grounding members and said back surface of said sheet member conveyor belt are set to increase in stepwise fashion from an upstream side toward a downstream side in said direction in which said sheet member conveyor belt moves.

7. A sheet member conveying device according to claim 6, wherein said grounding members are constituted by grounding rollers that have diameters which increase in stepwise fashion from an upstream side toward a downstream side in said direction in which said sheet member conveyor belt moves.

8. A sheet member conveying device according to claim 1, wherein said grounding means includes a plurality of grounding members that are disposed at predetermined intervals in a direction in which said sheet member conveyor belt moves, and wherein electrical resistances from said grounding members to ground are set to decrease in stepwise fashion from an upstream side toward a downstream side in said direction in which said sheet member conveyor belt moves.

9. A sheet member carrier device according to claim 1, wherein said grounding means includes a plurality of grounding members, and all of said grounding members contact said sheet member conveyor belt at said conveyance path portion.

* * * * *